US005157219A

United States Patent [19]

Calsson et al.

[11] Patent Number: 5,157,219

[45] Date of Patent: Oct. 20, 1992

[54] PRIMERS

[75] Inventors: Staffan Calsson; Tore Boberg; Sven Jones, all of Karlskoga, Sweden

[73] Assignee: Swedish Ordnance-FFV/Bofors AB, Sweden

[21] Appl. No.: 710,342

[22] Filed: Jun. 5, 1991

[30] Foreign Application Priority Data

Jun. 6, 1990 [SE] Sweden ..... 9002010

[51] Int. Cl.[5] ..... F42C 19/10

[52] U.S. Cl. ..... 102/204; 102/470

[58] Field of Search ..... 102/204, 469, 470, 430

[56] References Cited

U.S. PATENT DOCUMENTS

| | | | |
|---|---|---|---|
| 387,723 | 8/1888 | Lovenz | 102/470 |
| 3,195,463 | 7/1965 | Foote et al. | 102/204 |
| 3,306,203 | 2/1967 | Schaadt et al. | 86/1.1 |
| 3,726,221 | 4/1973 | White | 102/470 |
| 3,771,453 | 11/1973 | Ciccone et al. | 102/204 |
| 4,083,307 | 4/1978 | Beermann et al. | 102/470 |
| 4,619,202 | 10/1986 | Romer et al. | 102/470 |
| 4,686,905 | 8/1987 | Szabo | 102/470 |

FOREIGN PATENT DOCUMENTS

| | | | |
|---|---|---|---|
| 701664 | 6/1967 | Belgium . | |
| 80537 | 11/1947 | Czechoslovakia | 102/469 |
| 76160 | 5/1951 | Czechoslovakia | 102/469 |
| 310157 | 1/1918 | Fed. Rep. of Germany | 102/204 |
| 7990 | 3/1916 | United Kingdom | 102/204 |

*Primary Examiner*—Stephen M. Johnson
*Attorney, Agent, or Firm*—Pollock, Vande Sande & Priddy

[57] ABSTRACT

A firing pin initiated primer intended to withstand extreme loading forces, includes a capsule having an opening defined by a continuous, deformable side wall and being deformable by the firing pin impacting upon the capsule at the opposite end thereof, an anvil surrounded the capsule, and having an upper portion with a cross section substantially corresponding to that of the capsule, an unbroken lower suppport surface facing the capsule, at the end opposite to the opening and a sealing surface adjacent to the support surface, at least one radial channel formed in the anvil adjacent the sealing surface and extending from the periphery towards the center and converging into an axial channel defined in the anvil, a compartment defined by the supporting surface and bottom and side walls of the capsule and containing a pyrocharge therein, which has the entire upper surface abutting the unbroken support surface of the anvil, and at least one gap formed longitudinally outside of the capsule allowing for the partial deformation of the side wall of the capsule outwardly into the gap upon ignition of the pyrocharge so that the flame jets of the pyrocharge may pass the sealing surface and reach into the at least one radial channel.

10 Claims, 1 Drawing Sheet

PRIMERS

TECHNICAL FIELD

The present invention relates to a primer or percussion cap for artillery ammunition, initiated by a firing pin, the primer withstanding extremely high loading forces and ensuring a uniformly reproducible initiation of the main charge or propellant charge for which it is intended.

BACKGROUND ART

Firing pin-initiated primers are employed in artillery ammunition primarily for initiation of the powder charge in initiation fuses, but are also included in different types of impact fuses for shells.

In connection with the increase of, primarily, the rate of fire of anti-aircraft artillery and the introduction of automatic fire to guns of increasingly larger caliber, the need for primers which withstand extreme loading forces has also greatly increased. The term loading forces is used here for those forces which influence a charge or a cartridge when such is loaded in place in the barrel of the gun. Hence, such loading forces consist of a rapid acceleration when the cartridge or charge is thrown into the chamber, and a subsequent equally rapid retardation when it is arrested in its place in the chamber of the barrel.

The requirement that primers be capable of withstanding extreme loading forces is both one of safety, since initiation must not take place on loading, and one of function, since an initiation function which is impaired on loading will in turn influence the $V_o$ of the discharged projectile, that is its muzzle velocity.

A firing pin-initiated primer or percussion cap of the basic type under consideration here consists of a pressed or cast impact-sensitive pyrotechnical charge of a known type, a so-called anvil which abuts against the sides of the primer charge which face in the initiation direction thereof, that is towards the main or propellant charge which is to be initiated by the primer, and a protective case or capsule surrounding the other sides of the primer charge and consisting of at least partly deformable material.

The surface of the primer charge facing the anvil may also be covered by a readily destructible protective foil which, as a rule, mainly has a moisture-protective function. On the initiation of the primer, the case is, thus, to be deformed by a firing pin opposite the anvil so that the primer charge which, in such instance, is compressed between the anvil and the deformed case, is initiated. In the primer designs most commonly employed today, the anvil consists of a bent sheet bridge with gaps on either side thereof in order that the flame jets from the initiated primer charge will be able to reach the main or propellant charge. In other prior art primers, the anvil consists of a metal body perforated by some means for the passage of the flame jets. The drawback inherent in both of these basic types of anvil is that they leave greater or smaller parts of the upper surface of the primer charge wholly without support, either in the form of gaps beside the anvil or perforations through the anvil. Under extreme loading forces, there is, in these types of primer, a risk that the unsupported portion of the primer charge will be pulverized and, in the worst case scenario, this may result in an accidental initiation, but in any event always an uneven initiation with a varying $V_o$ (muzzle velocity) as a consequence.

SUMMARY OF THE INVENTION

The object of the present invention is to propose a firing pin-initiated primer which withstands extremely high loading forces. This has been realized by designing the anvil so as to offer an unbroken abutment surface against the entire upper surface of the primer charge, while the other defining surfaces of the primer charge are surrounded by the case. The fundamental principle of the primer according to the present invention is, thus, that the primer charge is, prior to initiation, to be wholly enclosed between the case and the anvil and that free passage apertures for the flame jets of the primer charge are not to be available until after the inner gas pressure formed on initiation of the primer charge has given rise to a deformation of the part or parts of the case where it is connected to the anvil and also suitably initially moisture-proof.

In the fully evolved state, this deformation is suitably in the form of one or more gaps extending along the edge of the anvil towards the case. Hence, there must be room outside the case for the deformation of the case which gives rise to these gaps. Furthermore, beyond the gaps, there must be accessible passages for the flame jets in the intended discharge direction of the primer.

Irrespective of the practical field of application, firing-pin initiated pyrocharges are quite small. They are seldom of a diameter which exceeds 5–6 mm even though the surrounding primer body (which may consist of several parts of which the case is the innermost) is often considerably larger. As a result of the small dimensions of the pyrocharge, the anvil proper will be of limited size. In order that the anvil according to the present invention be properly guided in or relative to the case, it is advantageous if, given its limited size, it is of at least the same length as its diameter. We have now found that the anvil may advantageously be designed as a cylinder with an obtusely conical support surface with rounded tip, with an immediately subsequent cylindrical sealing surface extending about the periphery of the support surface, and, subsequent to this sealing surface, a number of radial channels extending from the periphery in towards the center of the cylinder and coverging in an axial main channel defining the discharge direction. The thus designed anvil is then disposed in an appropriate cylindrical container or case which is open in the discharge direction of the primer, in whose closed bottom portion the pyrocharge is disposed and against whose upper surface facing the open upper portion of the case the anvil is brought into tight abutment with its conical portion. Since the outer dimensions of the anvil and inner dimensions of the case substantially coincide, there will be obtained a mutual seal therebetween along the sealing surface. This seal may possibly be improved by means of a sealant or by pressing the case fast against the anvil along this sealing surface. When the pyrocharge is initiated by the firing pin, an inner excess pressure will be generated in the initial phase and, provided that there is a space adapted therefor outside of the case, this will be deformed so that a gap is formed past the sealing surface of the anvil through which the flame jets and hot gases from the pyrocharge reach the radial channels and, via these, the axial channel where they are aimed in the main firing direction. The main channel is suitably covered by a sealing washer which prevents lose powder from the charge from falling down into the channel and being combusted by the hot gases. The sealing washer may also be combined with some form of suitable sealant mass.

Among the advantages afforded by this primer, in addition to withstanding extreme loading forces because of the protected position of the pyrocharge within completely continuous walls, an extremely distinct and uniform initiation is provided since the inner excess pressure must first be built up to a certain level before the case is deformed and the flame jets and gases gain free outlet. This makes for extremely uniform $V_o$ values in tube artillery. Moreover, the primer is relatively simple to manufacture in that different components may be individually produced and assembled only as a final manufacture stage. In conformity with prior art primers, the different parts are most preferably manufactured of brass.

BRIEF DESCRIPTION OF THE DRAWINGS

The nature of the present invention and its aspects will be more readily understood from the following brief description of the accompanying Drawings, and discussion relating thereto.

In the accompanying Drawings.

DETAILED DESCRIPTION OF THE PREFERRED EMBODIMENT(S)

Figure 1:
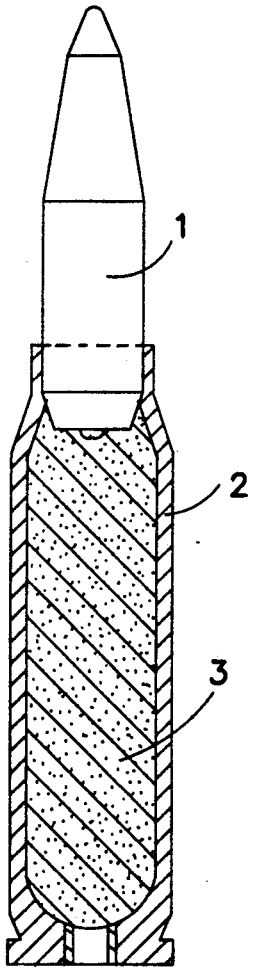
FIG. 1 shows partly in section a shell intended, for instance, for an AA gun.

The shell illustrated in FIG. 1 comprises a projectile 1, a case 2, a propellant charge 3 and a firing pin-initiated primer 4 of the type according to the present invention, mounted in the rear end of the case.

Figure 2:
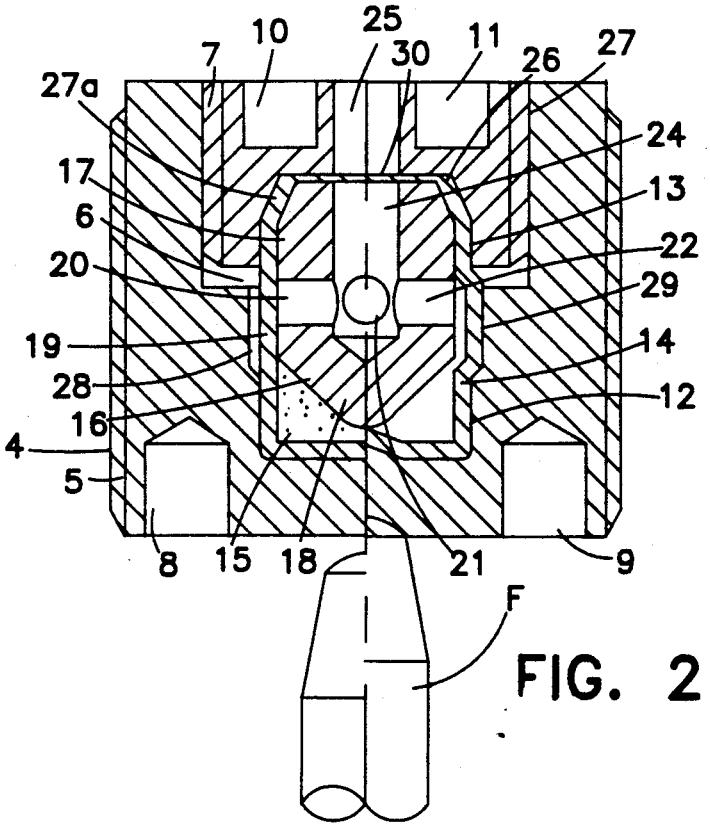
FIG. 2 is, on a different scale, a side elevation in section of the primer according to the present invention, in which the left-hand part of the figure shows the primer in the inactivated state and the right-hand section in the triggered state.
Figure 3:
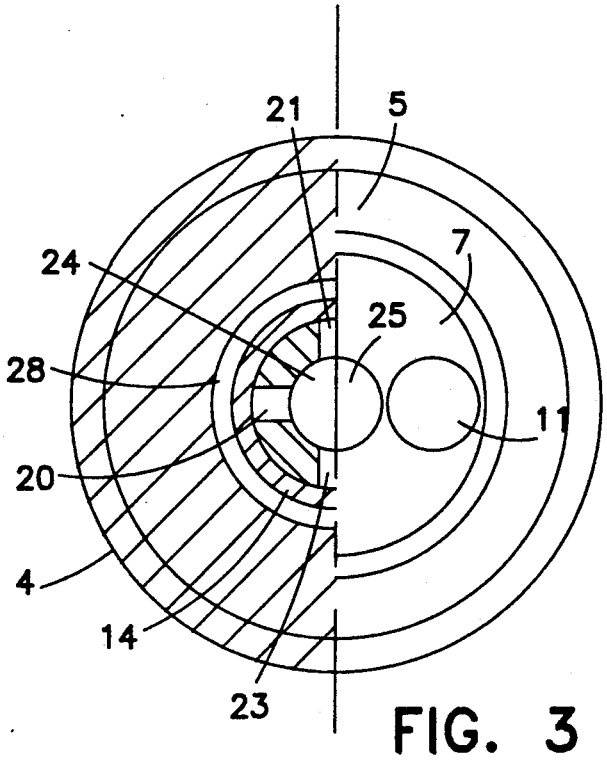
FIG. 3 is a plan view of the primer of FIG. 2 taken partly along the line III—III of FIG. 2.

The primer 4 illustrated in greater detail in FIGS. 2 and 3 comprises an exteriorly threaded outer case 5 provided with an exteriorly threaded lid 7 mounted in an interiorly threaded bore 6. The lid 7 must always abut against the anvil 16. Both the outer case 5 and its lid 7 are, at their mutually opposing end edges, provided with bores 8–11 which function as anchorages for appropriate tools.

A bore 12 is provided in the axial center of the outer case and continues with a second portion 13 in the inwardly facing side of the lid. In this bore, there is disposed a case or capsule 14 which is cylindrical and is mounted with its open end facing towards the lid 7. In the bottom portion of the capsule 14 opposite to the aperture, there is disposed a pressed, impact-sensitive pyrocharge 15. There is further provided, inc lose abutment against the upper side of the pyrocharge, an anvil 16 which has a cylindrical portion 17, an obtusely conical contact portion 18 with rounded tip facing towards the pyrocharge, the contact portion being immediately followed by a cylindrical sealing portion 19 and, after the sealing portion 19 (seen in the direction of the primer), four channels 20–23 leading from the periphery of the anvil and radially in towards its center, these channels in turn converging in an axial channel 24 which has a continuation 25 through the lid 7. The inner diameter of the capsule 14 substantially corresponds to the outer diameter of the cylindrical portion 17 of the anvil and its sealing portion 19, which provides a sealing therebetween when the anvil is mounted in the capsule. The upper portion of the anvil facing the lid 7 is further provided with a restricted conical taper 26 having its counterpart in a cone 27 of the inner portion of the bore 13 in the lid 7. This provides, when the lid 7 is screwed in place, an extra seal between the anvil and the capsule and most important, support in the axial direction also of the capsule and thereby of the anvil 16 against retardation forces on loading.

Since the anvil 16 must have a direct abutment in the lid 7, the walls of the capsule 14 may not extend right up to the upper edge of the anvil, for which reason a gap 27*a* is formed uppermost towards the lid 7.

The axial channel 24 is further covered by a light metal washer 30 which prevents loose powder from falling down into the channel and which may readily be combusted by the hot gases formed when the pyrocharge is initiated.

As has already been pointed out, the left-hand sections of FIGS. 2 and 3 illustrate the primer in its original, noninitiated state, while the right-hand section of FIG. 2 shows the primer after initiation. As will be apparent from the left-hand figure sections, there is a gap 28 outside the capsule, flush with the channels 20–23 and the sealing portion 19 and extending somewhat past the sealing portion.

When the firing pin F which is employed for initiating the primer strikes the bottom of the outer casing 5 and when, by deformation thereof and of the capsule 14, the primer charge 15 is compressed against the anvil 16 the primer charge is initiated and an excess pressure is initially built up. This excess pressure results in a deformation of the capsule at the only conceivable place, that is flush with the gap 28, where then the bulge is formed bulge which is apparent from the right-hand section of FIG. 2, as being designated 29. In such instance, a free passage is created for the flame jets and the hot powder gases from the combusted pyrocharge past the sealing surface 19 via the channels 20–23 and out via the main channel 24 through the washer 30 and further via the channel 25 to the main powder charge.

This makes for collective ignition in the desired direction of initiation. Since an inner excess pressure must first be built up in the capsule before the passage past the sealing surface 19 is exposed, the ignition flames will act with full force immediately on departing from the primer. This provides extremely uniform ignition and resultant muzzle velocity $V_o$.

What we claim and desire to secure by Letters Patent is:

1. A primer adapted for initiation by a firing pin and intended to withstand high loading forces, said primer comprising:

a capsule having an opening defined by a continuous, deformable side wall and a posterior end opposite said opening, said side wall enclosing an interior space, said capsule also having an interior surface, and an exterior surface, said capsule being deformable by said firing pin impacting upon the capsule at the exterior surface of the posterior end thereof;

an anvil inserted into said interior space and surrounded by said capsule, said anvil having an upper portion with a cross section substantially corresponding to the cross section of the capsule, an unbroken lower support surface forming bottom portion of said anvil and facing the posterior surface of the capsule, and a sealing surface which is formed along a lower part of said upper portion and meets with an outer edge outwardly restricting said supporting surface, said sealing surface sealingly abutting the interior surface of the side wall of said capsule;

at least one radial channel formed in said anvil adjacent the sealing surface and extending from a periphery of the anvil towards the center of the anvil, and converging into an axial main channel defined in said anvil in its longitudinal direction coinciding with the discharge direction of the primer;

a compartment defined by said supporting surface of the anvil, said posterior inner surface of the capsule, and the side walls of the capsule, with the sealing surface preventing moisture from entering the compartment;

a pyrocharge contained within the compartment, said pyrocharge having an upper surface, the entire upper surface of said pyrocharge abutting said unbroken support surface of said anvil; and at least one gap formed longitudinally outside said exterior surface of said capsule along said side wall of said capsule from the location slightly below said sealing surface towards the location of said at least one radial channel;

wherein said gap allows for the partial deformation of the side wall of said capsule outwardly into said gap upon ignition of the pyrocharge so that the flame jets of the pyrocharge may pass the sealing surface and reach into said at least one radial channel.

2. The primer as claimed in claim 1 wherein said unbroken support surface of said anvil is in the form of an obtuse cone with a rounded tip.

3. The primer as claimed in claim 2, further comprising a sealing layer for sealing said opening of said capsule which hot gasses of said pyrocharge are capable of burning through.

4. The primer as claimed in claim 1, further comprising an outer case having a main outer part and an inner lid part being threaded in one another and between which said capsule with said anvil mounted therein are secured, wherein said at least one gap is provided in said main part of the outer case, and wherein at least the outer case part facing the firing pin is made of a material which is deformable by the firing pin to a sufficient degree such that the capsule may also be deformed to a sufficient degree by said outer case part and said pyrocharge is initiated when it is compressed against said anvil.

5. The primer as claimed in claim 4, wherein said outer case is designed such that the capsule inserted therein is forced, along an upper edge of the capsule forming said opening, into close abutment against said anvil, so that combustion gases and flame jets of the pyrocharge are prevented from passing out between said upper edge of said capsule and an upper edge of said anvil, thereby being wholly directed into said at least one radial channel.

6. The primer as claimed in claim 5, further comprising a sealing layer for sealing said opening of said capsule which hot gasses of said pyrocharge are capable of burning through.

7. The primer as claimed in claim 1, further comprising a sealing layer for sealing said opening of said capsule which hot gasses of said pyrocharge are capable of burning through.

8. A primer adapted for initiation by a firing pin, and intended to withstand extreme loading forces, said primer comprising:

an impact-sensitive pyrocharge;

a capsule or case for encapsulating said pyrocharge, said capsule being deformable by the firing pin and surrounding said pyrocharge from all sides apart from one upper side which faces in the discharge direction of said primer; and an anvil inserted into said capsule and abutting at one end thereof against said one upper side of said pyrocharge and against which the pyrocharge is to be compressed for ignition upon deformation of said capsule by the firing pin, said anvil including a continuous unbroken support surface, along said one abutting end for closely abutting against an entire opposing surface of the upper side of the pyrocharge, said anvil also including a side wall;

said wall of said anvil being cylindrical and said unbroken support surface being obtusively conical, said anvil including a sealing surface located adjacent said unbroken support surface in the longitudinal direction of said anvil and a plurality of radial channels positioned above said sealing surface and extending from a periphery towards a center of said anvil, said channels converging into an axial main channel leading towards the discharge direction of said primer;

said anvil being disposed in said capsule which also forms a cylindrical container having one end open towards the discharge direction and having substantially the same inner diameter as the outer diameter of the anvil; and wherein upon the upper surface of said pyrocharge being pressed against said conical unbroken surface of said anvil and wherein said capsule is disposed in a cavity in an outer case, said outer case, from at least a point at which said capsule flushes with the sealing surface of the anvil and to the radial channels inclusive, includes an inwardly projecting gap which allows deformation of the capsule into said gap such that a passage is formed between the walls of said anvil and said capsule whereby flame jets of the pyrocharge may pass said sealing surface and reach said radial channels.

9. The primer as claimed in claim 8, wherein said outer case includes a main outer part and an inner lid part being threaded in one another and between which said capsule with said anvil mounted therein are secured, wherein said gap is provided in said main part of the outer case, and wherein at least the outer case part facing the firing pin is made of a material which is deformable by the firing pin to a sufficient degree such that the capsule may also be deformed to a sufficient degree by said case part and said pyrocharge is initiated when it is compressed against said anvil.

10. The primer as claimed in claim 9, wherein the cavity of said outer case is designed such that the capsule inserted therein is forced, along an upper edge of the capsule into close abutment against said anvil so that combustion gases and flame jets of the pyrocharge are prevented from passing out between the upper edge of said capsule and an upper edge said anvil, thereby being wholly directed into said radial channels.

* * * * *